United States Patent [19]

Held et al.

[11] 4,347,775

[45] Sep. 7, 1982

[54] PLUG FOR MOUTHPIECE OF A WOODEN RECORDER

[75] Inventors: Hans-Dieter Held; Waldemar Schaller, both of Trossingen, Fed. Rep. of Germany

[73] Assignee: Matth. Hohner AG, Trossingen, Fed. Rep. of Germany

[21] Appl. No.: 265,540

[22] Filed: May 20, 1981

[30] Foreign Application Priority Data

Jun. 19, 1980 [DE] Fed. Rep. of Germany ..... 3022822

[51] Int. Cl.[3] ..... G10D 7/02

[52] U.S. Cl. ..... 84/380 C

[58] Field of Search ..... 84/380 C

[56] References Cited

FOREIGN PATENT DOCUMENTS 7605033 7/1976 Fed. Rep. of Germany .... 84/380 C 1322588 7/1973 United Kingdom ..... 84/380 C

*Primary Examiner*—Lawrence R. Franklin

*Attorney, Agent, or Firm*—Karl F. Ross

[57] ABSTRACT

A plug for the mouthpiece of a wooden recorder, molded integral from plastic material, has a concave and a flat end wall interconnected by side and intermediate walls. A lower side wall, or an intermediate wall parallel thereto, has one or two outer humps designed to contact the inner mouthpiece surface and is sufficiently deformable to flex inward upon insertion into the mouthpiece.

5 Claims, 7 Drawing Figures

PLUG FOR MOUTHPIECE OF A WOODEN RECORDER

FIELD OF THE INVENTION

Our present invention relates to a plug insertable into a mouthpiece of a wooden recorder to define therewith a narrow flue which extends parallel to the axis of the instrument body and terminates at a lateral wall aperture of the body separating the mouthpiece from a lip pointing toward the flue.

BACKGROUND OF THE INVENTION

In our commonly owned copending application Ser. No. 190,167, filed Sept. 23, 1980, now abandoned we have disclosed a plug of this type, molded integrally from synthetic resin, in combination with a recorder whose body including the mouthpiece consists of the same kind of material. The plug, as also known from commonly owned German utility model No. 76 05 033 published July 8, 1976, is a unitary member with a concave front end wall, a flat rear end wall and a plurality of connecting walls therebetween, specifically an upper wall designed to form the flue boundary, a shorter lower wall remote from the flue and a pair of intersecting reinforcing webs respectively parallel and perpendicular to the upper and lower walls. The outline of the front wall, when projected upon the plane of the rear wall, registers with the circular outline of the latter whereby the two end walls define sections of an imaginary cylinder encompassing the outer surface of the lower wall. This wall structure forms four laterally open voids which reduce the weight of the plug as well as the amount of plastic material required for its manufacture; two of these voids, pursuant to the teaching of our copending application, also facilitate the attachment thereto of an insert with a generally U-shaped profile which fits into the flue and comes to rest against an inner peripheral surface of the mouthpiece while leaving an air channel between itself and the plug.

Since synthetic resins are relatively dimensionally stable with changing ambient temperature and humidity, the interfitting of molded plugs and mouthpieces presents no particular problem. When, however, such a plug is to be used with a wooden recorder, the instrument body tends to shrink and swell under varying climatic conditions; its mouthpiece, in particular, also expands inward in response to moist air blown by the player.

Thus, the bore of the mouthpiece designed to accommodate the plug cannot be dependably dimensioned to form a closely fitting seat around the plug. If its inner diameter increases, the plug may not stay securely in place; if it decreases, the presence of the plug may crack the head or fipple of the instrument.

OBJECT OF THE INVENTION

The object of our present invention, therefore, is to provide an improved construction for a molded plug designed to fit into the mouthpiece of a wooden recorder with avoidance of the aforementioned seating problem.

SUMMARY OF THE INVENTION

We realize this object, in accordance with our present invention, by providing at least one of the connecting walls of the plug member (other than its upper wall designed to form the flue boundary) with a portion which extends along the periphery of an imaginary cylinder defined by the outlines of the two end walls, this portion having an external hump adapted to contact an adjacent inner wall surface of the mouthpiece and to be resiliently inwardly deformed under contact pressure between the hump and the mouthpiece.

The humped wall portion referred to may be part of the aforementioned lower wall remote from the flue, in which case it is desirable to terminate a transverse central web short of the lower wall in order to give this wall the necessary flexibility.

Alteratively, two such humps may be formed on lateral edge portions of an intermediate web or septum paralleling the upper wall which form the boundaries of a middle cutout thereof and which thus also have the desired degree of flexibility.

BRIEF DESCRIPTION OF THE DRAWING

The above and other features of our invention will now be described in detail with reference to the accompanying drawing in which.

SPECIFIC DESCRIPTION

Figure 3:
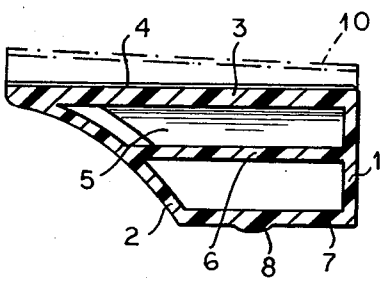
FIG. 3 is a longitudinal sectional view taken on the line III—III of FIG. 2.
Figure 2:
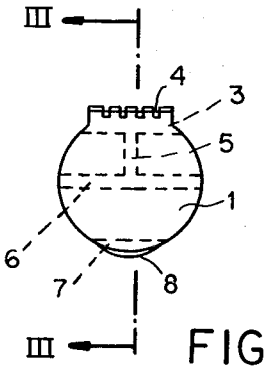
FIG. 2 is a rear-end view of the plug shown in FIG. 1.

In FIGS. 1-4 we have shown an integrally molded plug of synthetic resin comprising a rear end wall 1 in the form of a flat, substantially circular disk, a front end wall 2 with a concave outer surface accommodating the lower lip of a player, and several connecting walls including a relatively long upper wall 3, a relatively short lower wall 7, a central web 6 perpendicular to these two walls, and a septum 6 midway between walls 3 and 7 which forms a T-shaped junction with web 5. Septum 6, which has a length intermediate that of top and bottom walls 3 and 7, is joined to both end walls 1 and 2 whereas web 5 has a forward edge spaced from front wall 2; this web also terminates in the plane of septum 6, i.e. short of lower wall 7.

Top wall 3 is formed on its outer surface, adjoining a flue of a mouthpiece into which the plug is inserted, with a multiplicity of parallel grooves 4 which extend parallel to the flue and serve to collect precipitating moisture from the player's breath. Grooves 4 could also be intersected by transverse grooves as shown in the German utility model No. 76 05 033 referred to above.

In accordance with our present improvement, the lower wall 7 of the plug seen in FIGS. 1-4 is provided with an external hump 8 designed to contact an adjoining wall surface of the surrounding mouthpiece (not shown). Since wall 7 is not braced by a transverse web, it can resiliently deform under an upward pressure from the mouthpiece wall acting upon the hump 8 when the plug is inserted with a tight fit. Should the diameter of the mouthpiece bore increase, wall 7 would tend to straighten itself out so as to maintain a firm contact between the mouthpiece and the hump.

Figure 5:
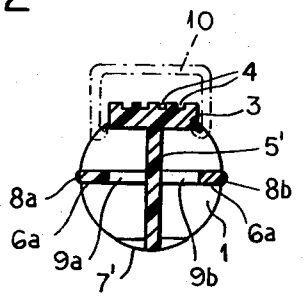
FIG. 5 is a cross-sectional view of a modified plug according to our invention.
Figure 7:
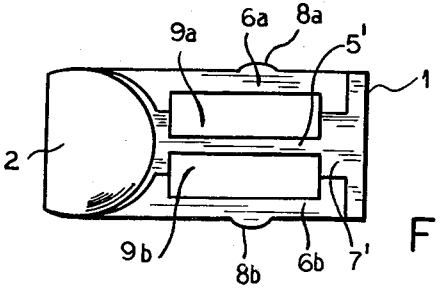
FIG. 7 is a bottom view of the plug illustrated in FIGS. 5 and 6.
Figure 1:
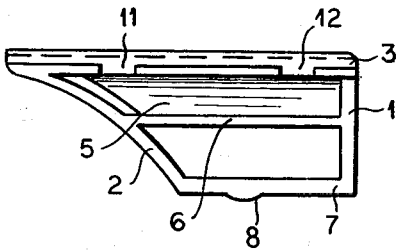
FIG. 1 is a side view of a mouthpiece plug embodying our invention.
Figure 4:
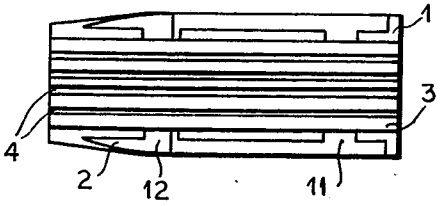
FIG. 4 is a top view of the plug shown in FIGS. 1-3.
Figure 6:
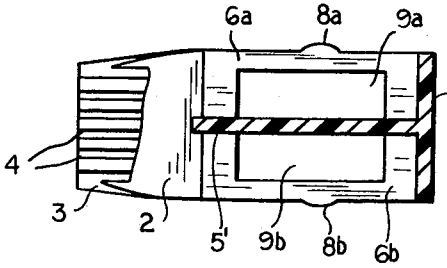
FIG. 6 is a top view (parts broken away) of the plug shown in FIG. 5.

In FIGS. 5–7 we have illustrated a modified plug in which the continuous septum 6 of the preceding embodiment has been replaced by a partition in the form of a rectangular frame with lateral edges 6*a*, 6*b* and a middle cutout bisected by a transverse web 5' so as to form two rectangular slots 9*a* and 9*b*. Web 5' extends here over the full height of the plug so that its lower edge merges into a bottom wall 7' which, however, is partly cut away to facilitate the molding of the frame-like septum; thus, wall 7' underlies only solid parts of the septum. The two lateral septum edges 6*a* and 6*b* are resiliently flexible and carry respective humps 8*a* and 8*b* for the purpose described above.

In FIGS. 3 and 5 we have also indicated, in phantom lines, the possibility of affixing to the plug a generally U-shaped insert 10 defining with its grooved upper wall 3 an air channel as described in our copending application Ser. No. 190,167. Insert 10 has hooks fitting into notches 11, 12 (see FIGS. 1–4) of upper wall 3.

We claim:

1. A plug for a mouthpiece of a wooden recorder, comprising an integrally molded member with a concave front end wall, a flat rear end wall and a plurality of connecting walls between said end walls, said connecting walls including an upper wall adapted to form a boundary for a flue of the mouthpiece upon insertion of the plug into same, said end walls defining sections of an imaginary cylinder, at least one of said connecting walls other than said upper wall having a portion which extends along the periphery of said imaginary cylinder and is provided with an external hump adapted to contact an adjacent inner wall surfce of the mouthpiece into which the plug has been inserted, said portion being resiliently inwardly deformable under contact pressure between said hump and the mouthpiece.

2. A plug as defined in claim 1 wherein said portion is part of a lower connecting wall shorter than said upper wall.

3. A plug as defined in claim 2 wherein said connecting walls include a central web transverse to said upper and lower walls, said central web terminating short of said lower wall.

4. A plug as defined in claim 1 wherein said connecting walls include a septum parallel to said upper and lower walls, said septum having a middle cutout bounded by two lateral edges constituting said portion, said external hump being provided on each of said lateral edges.

5. A plug as defined in claim 4 wherein said connecting walls further include a central web transverse to said septum bisecting said cutout and terminating at a lower wall underlying only solid parts of said septum.

* * * * *